US005517979A

United States Patent [19]

Closson

[11] Patent Number: 5,517,979

[45] Date of Patent: May 21, 1996

[54] SHOCK ABSORBING DEVICE FOR BOWS

[76] Inventor: Robert A. Closson, 109 Hwy. 12 East, Townsend, Mont. 59644

[21] Appl. No.: 180,353

[22] Filed: Jan. 12, 1994

[51] Int. Cl.[6] ..... F41B 5/14; F41G 1/467

[52] U.S. Cl. ..... 124/86; 124/87; 124/89; 33/265

[58] Field of Search ..... 124/23.1, 24.1, 124/44.5, 86–89; 33/265; 248/618, 624, 613; 267/136

[56] References Cited

U.S. PATENT DOCUMENTS

| | | | |
|---|---|---|---|
| 1,726,244 | 8/1929 | Shefstead | 248/613 |
| 3,412,725 | 11/1968 | Hoyt | 124/89 X |
| 4,496,130 | 1/1985 | Toyama | 267/136 X |
| 4,704,800 | 11/1987 | Stinson | 33/265 |
| 4,988,065 | 1/1991 | Leban et al. | 248/624 X |
| 5,001,837 | 3/1991 | Bray | 33/265 |
| 5,048,193 | 9/1991 | Hacquet | 33/265 |
| 5,285,767 | 2/1994 | Padilla | 124/87 |

*Primary Examiner*—Eric K. Nicholson
*Attorney, Agent, or Firm*—Breiner & Breiner

[57] ABSTRACT

A shock absorbing device for a bow which is fixedly mounted on a bow or made integral with a bow and which is provided with a mount for a bow accessory such as a bow sight which mount is moveable by the expansion or compression of a spring in response to the shock generated by the bow to avoid loosening or breakage of the bow accessory by the shock generated by the bow.

11 Claims, 3 Drawing Sheets

B
S
10
12
14
20
22
25
25a
26
27
28
30
32
34
36
38
40
50
52
54
56

SHOCK ABSORBING DEVICE FOR BOWS

FIELD OF THE INVENTION

This invention relates in general to new and useful improvements in shock-absorbing devices, and more particularly, to a novel shock absorbing device for use on bows.

BACKGROUND OF THE INVENTION

Archery and bow hunting have become increasingly popular sports. This popularity has spawned increasingly sophisticated bows, arrows and bow accessories such as bow sights, quivers, arrow rests and the like. See for example U.S. Pat. Nos. 4,541,179; 4,664,093; 4,907,567; 5,052,364; 5,085,201; and 5,123,396.

A number of these bow accessories are attached to the bow or are made integral with the bow. For example, my U.S. Pat. No. 4,541,179 teaches a unique sighting device for use on bows. The sighting device disclosed in my patent, as well as other sighting devices, are fixedly mounted on the bow by means of a spacer and suitable fasteners such as threaded screw members. With the advent of increasingly "faster" bows, i.e., bows constructed of new materials and designed to provide greater speed and trajectory to the arrows, substantial shock is generated to the bow upon release of the arrow. This shock to the bow is a problem as it causes parts on the attached bow accessories, such as the parts on my sighting device, to loosen, to fall off or to sometimes break.

Additionally, bow stabilizing attachments are also known in the art such as disclosed, for example, in U. S. Pat Nos. 3,412,725; 3,658,157 and 3,757,764.

Accordingly, there is a need in the field of archery and bow hunting for a means to absorb the shock generated by the bow to avoid the problem of the loosening of parts on bow accessories, the loosening of the bow accessories on the bow or the breakage of the bow accessories.

PRIMARY OBJECTS AND BRIEF DESCRIPTION OF THE INVENTION

It is a primary object of the invention to provide a shock absorbing device for bows and bow accessories to absorb the shock generated by the bow and to prevent the shock from reaching and adversely affecting the bow accessories.

It is a further primary object of the invention to provide a shock absorbing device for use with bows which can be attached to a bow or made integral with the bow.

It is a further object of the invention to provide a shock absorbing device for bows which is simple in construction, inexpensive to manufacture and easy to use.

The shock absorbing device of the invention comprises a mounting plate for mounting the device to a bow, and a means for mounting a bow accessory such as a bow sight which is movably connected to the mounting plate and will move under shock from the bow, thereby precluding shock to the bow accessory. In the alternative, the shock absorbing device can be made integral with the bow and the bow accessory mounting means is movably attached to the bow and will move under shock from the bow, thereby precluding shock to the bow accessory.

BRIEF DESCRIPTION OF THE DRAWING

Other objects, advantages and novel features of the present invention will become apparent from the following detailed description of the invention when considered in conjunction with the accompanying drawing, in which like reference numerals designate like parts throughout the figures thereof, and wherein.

DETAILED DESCRIPTION OF THE PRESENTLY PREFERRED EMBODIMENTS OF THE INVENTION

Figures 1, 2, 3, 4:
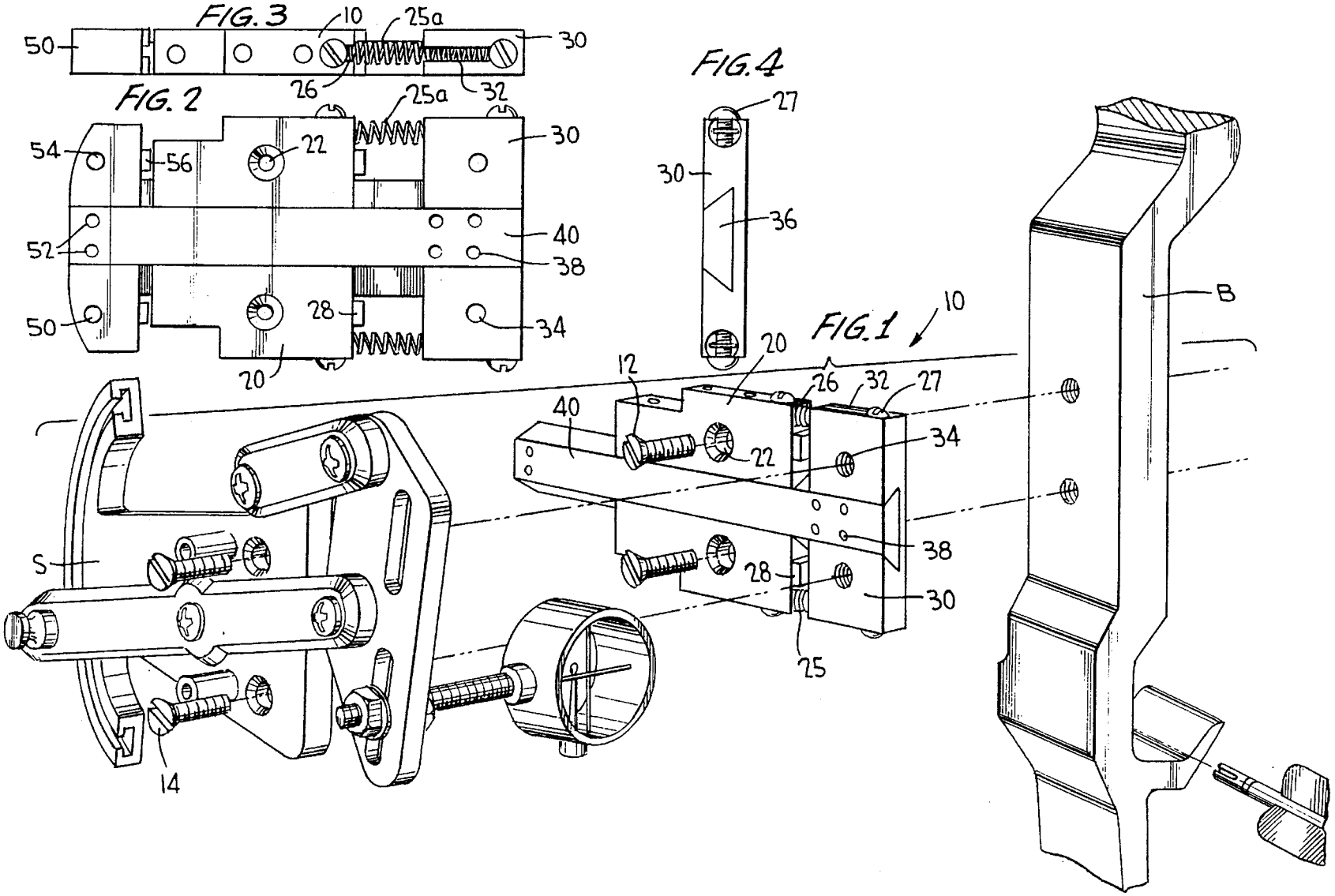
FIG. 1 is an exploded perspective view of the shock absorbing device of the invention attached to a bow and with a sight device attached thereto wherein the shock absorbing device includes an expansion spring means.
FIG. 2 is a top plan view of the shock absorbing device of the invention of an alternative embodiment wherein a compression spring means is utilized.
FIG. 3 is a side view of the shock absorbing device of the invention of FIG. 2.
FIG. 4 is an end elevational view of the bow accessory mount of the shock absorbing device of the invention of FIG. 1.
Figure 5:
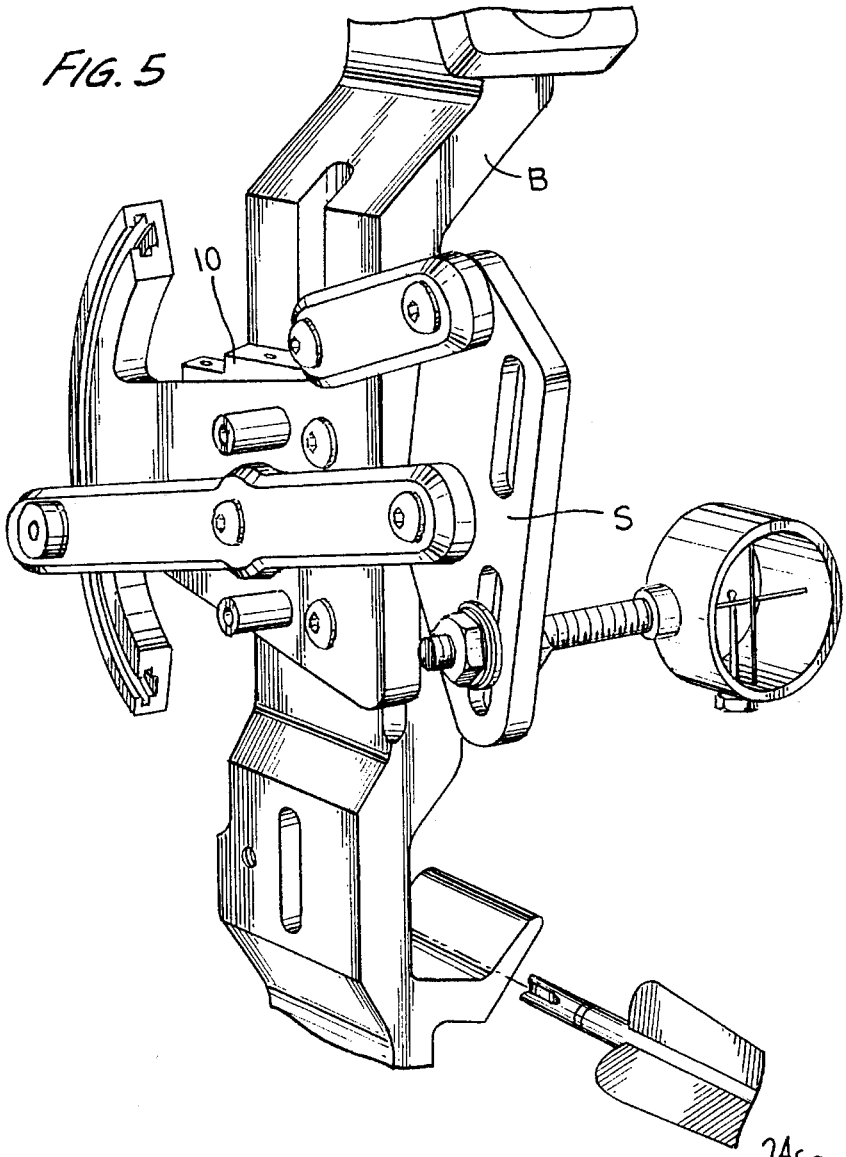
FIG. 5 is a front perspective view of the shock absorbing device of FIG. 1 attached to a bow and with a sight attached thereto.
Figure 6:
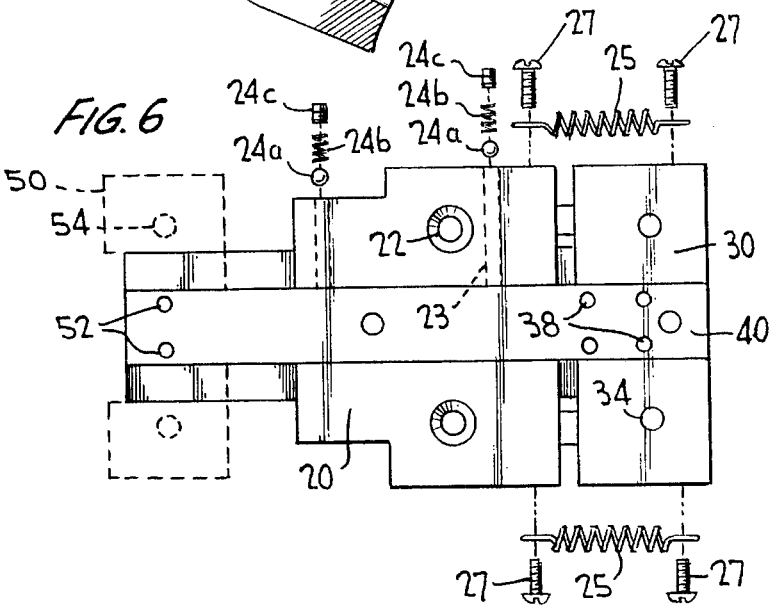
FIG. 6 is a top plan view of the shock absorbing device of the invention having an expansion spring means.

Referring to FIG. 1, there is shown an exploded view of one preferred embodiment of the shock absorbing device 10 of the invention attached to a bow B and with a bow sight S of the type disclosed in my U.S. Pat. No. 4,541,179 and sold under the trademark SIGHTMASTER® attached to the shock absorbing device 10. The shock absorbing device 10 is attached to the bow by any suitable fastening means 12, such as a screw means or the like. Similarly, bow sight S is attached to the shock absorbing device 10 by any suitable fastening means 14, such as a screw means or the like. FIG. 5 further shows the shock absorbing device 10 as actually attached to bow B and bow sight S attached to shock absorbing device 10.

Referring to the drawing, a preferred embodiment of shock absorbing device 10 includes a mounting plate 20, a bow accessory mount 30 and a slide bar 40. A further mount 50 can also be connected to slide bar 40 at fastening holes 52 by suitable fastening means (not shown) such as screws or the like. A quiver or other bow accessory, if desired, can be mounted to mount 50 through holes 54.

Mounting plate 20 includes fastening holes 22 for mounting the plate 20 to bow B by fastening means 12. The mounting plate 20 also includes vertically extending holes 23 for receiving nylon balls **24*a*, compression springs 24*b*, and allen screws 24*c* (FIG. 6) for providing a smooth and noiseless sliding motion of the slide bar 40. The mounting plate 20 and bow accessory mount 30 are connected by a suitable compression or expansion means which allows movement of accessory mount 30 in response to shock generated by the bow upon release of an arrow. In one preferred embodiment as shown in FIGS. 1, 4, 5 and 6, these means are expansion spring means 25 which are held in place in countersunk holes 26 in the mounting plate 20 and countersunk holes 32 in accessory mount 30 by a suitable fastening means such as allen head button screws 27 or the like. Mounting plate 20 also includes rubber bumpers 28 to stop accessory mount 30** when in an unexpanded state, or, as in the alternative embodiment, a compressed state. Thus, when an arrow is released from the bow and shock generated by the bow, any shock of the bow is absorbed by expansion of the accessory mount. This precludes loosening of parts on the sight or breakage of the sight caused by the shock.

Figure 7:
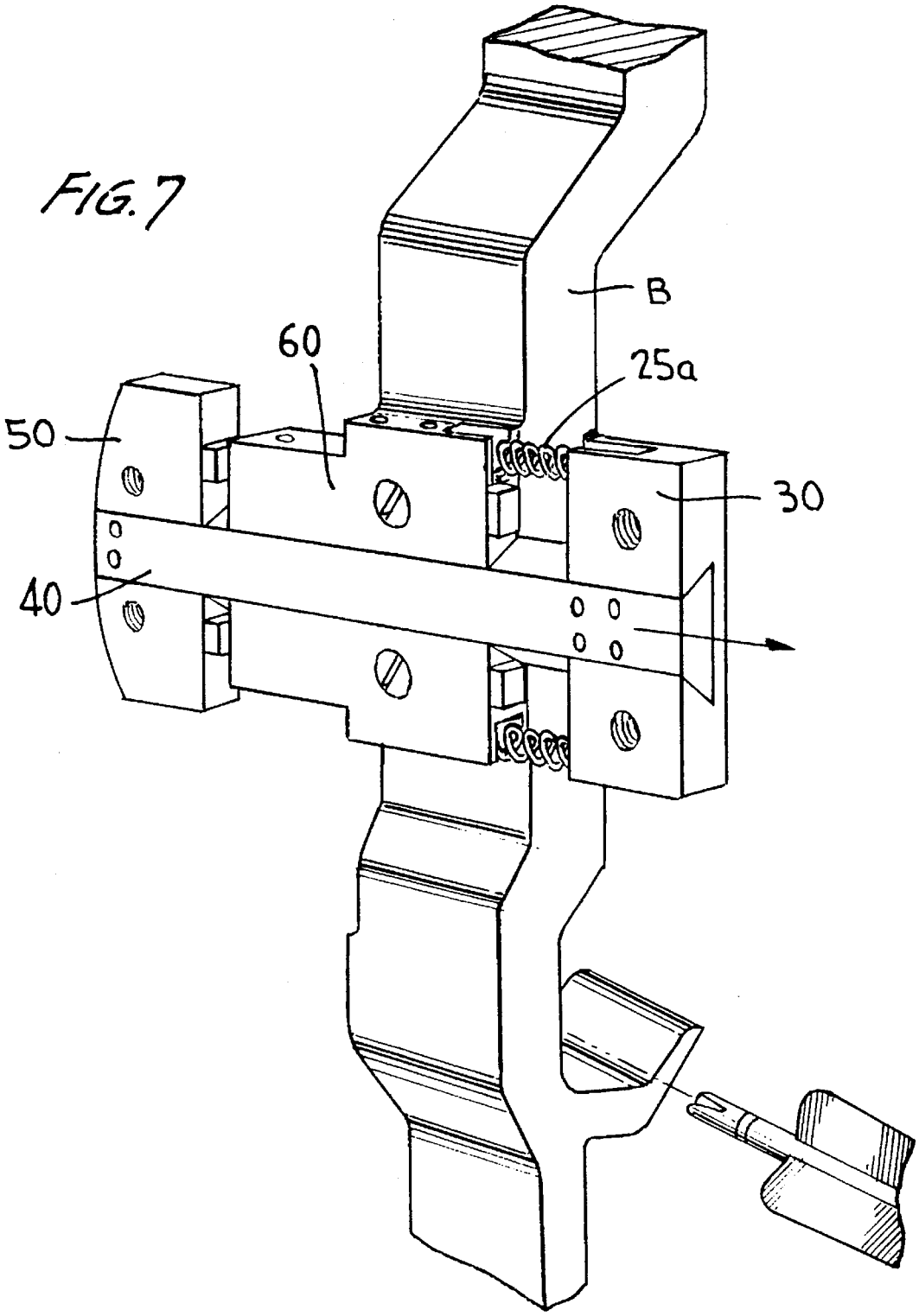
FIG. 7 is a front perspective view of the shock absorbing device of the invention made integral with the bow and having a compression spring means.

In an alternative preferred embodiment as shown in FIGS. 2, 3 and 7, the spring means 25*a* is a compression spring whereby the accessory mount compresses in response to shock. When using the compression spring means 25*a*, the springs can be held in place in the countersunk holes 26 and 32 without need for screws 27. Additionally, mount 50 is used with bumpers 56 in order to keep the slide bar 40 in place and from sliding off. Thus, when the arrow is released and shock generated by the bow, any shock is absorbed by compression of the accessory mount. It is understood that other compression or expansion means can be useful in the invention other than a spring means as above described such as a piston means, a telescoped shock absorber or the like.

Mounting plate 20 includes an opening as apparent from the drawing for movably receiving slide bar 40. Slide bar 40 is free to slide through the opening in response to shock generated by the bow. As seen above, nylon balls 24*a* provide for smooth and noiseless sliding of slide bar 40.

Accessory mount 30 includes fastening holes 34 for receiving fastening means 14 and mounting a bow accessory. Mount 30 further has an opening 36 similar to that of mounting plate 10 for receiving and attachment of slide bar 40 by any suitable fastening means such as fastening holes 38 and allen screws (not shown).

Slide bar 40, as seen above, is constructed and arranged to mate with mounting plate 20 and accessory mount 30 and is free to slide in mounting plate 20.

FIG. 7 illustrates shock absorbing device 60 of the invention made integral with the bow B. In this embodiment, the mounting plate 20 as previously described above is made as part of the bow. The remaining parts of the invention shown in FIG. 7 are as is disclosed and discussed above for FIG. 2 utilizing a compression spring means.

Thus, in operation, when an arrow is released from bow B, the shock generated by the bow on such release is not transferred to the bow accessory, in this case sight S, due to shock absorbing device 10, as the accessory mount is either compressed or expanded to absorb the shock.

The above described invention provides a new and unique shock absorbing device for bows which is simple in construction, inexpensive to manufacture, and easy to use. While a preferred embodiment of the shock absorbing device has been described in detail above, various modifications and variations of the invention are possible in light of the above teachings. It is, therefore, to be understood that within the scope of the appended claims the invention can be practiced otherwise than as above-described.

It is claimed:

1. A bow including a means for mounting a bow accessory and wherein said means for mounting a bow accessory includes a spring means connected to said bow and said means for mounting a bow accessory, and a slide bar fixedly attached to said means for mounting a bow accessory and attached to said bow in sliding relation wherein said means for mounting a bow accessory is free to move in response to shock generated by said bow.

2. A shock absorbing device for use on a bow comprising a means for mounting said device on said bow, a means for mounting a bow accessory connected to said means for mounting said device on said bow and a slide bar fixedly attached to said means for mounting a bow accessory and movably attached to said means for mounting said device on said bow for absorbing shock generated by said bow.

3. A shock absorbing device according to claim 2 wherein said slide bar means includes at least one spring means connectively attached to said means for mounting said device on said bow and said means for mounting a bow accessory.

4. A shock absorbing device according to claim 3 wherein said at least one spring means comprises an expansion spring.

5. A shock absorbing device according to claim 3 wherein said at least one spring means comprises a compression spring.

6. In combination with a bow, a shock absorbing device constructed and arranged for attachment to said bow, said device comprising a mounting plate having a plurality of openings for receiving fastening means for mounting said device to said bow; a bow accessory mounting means for connectively attaching a bow accessory to said mounting plate by a compression means, said compression means being constructed and arranged with said mounting plate and said bow accessory mounting means in order that said compression means compresses to absorb shock generated by said bow.

7. A shock absorbing device according to claim 6 wherein said compression means comprises at least one spring means.

8. A shock absorbing device according to claim 6 wherein said mounting plate includes means for movably receiving a slide bar and said bow accessory mounting means includes means for attachably receiving said slide bar.

9. A shock absorbing device for a bow comprising a mounting plate for mounting said device to a bow and which includes means for movably receiving a slide bar; a bow accessory mounting means having a means for mounting a bow accessory and means for attachably receiving a slide bar; a slide bar constructed and arranged to attachably engage said bow accessory mounting means and to movably engage said mounting plate; and spring means which connectively attaches said mounting plate to said bow accessory mounting means, and wherein said bow accessory mounting means moves in response to shock generated by said bow.

10. A shock absorbing device according to claim 9 wherein said spring means comprises at least one compression spring.

11. A shock absorbing device according to claim 9 wherein said spring means comprises at least one expansion spring.

* * * * *